US005139577A

United States Patent [19]

Brock

[11] Patent Number: 5,139,577

[45] Date of Patent: Aug. 18, 1992

[54] HIGH CAPACITY GOLF BALL PROCESSING SYSTEM AND METHOD

[76] Inventor: James R. Brock, 1401 N. Rhodes St., No. 405, Arlington, Va. 22209

[21] Appl. No.: 809,834

[22] Filed: Dec. 17, 1991

Related U.S. Application Data

[63] Continuation of Ser. No. 522,309, May 11, 1990, abandoned.

[51] Int. Cl.[5] ..... B08B 9/00; B08B 13/00

[52] U.S. Cl. ..... 134/25.4; 134/61; 134/104.3; 134/133; 15/21.2; 15/3.16

[58] Field of Search ..... 134/25.4, 60, 61, 133, 134/186, 104.3; 15/21.2, 3.16

[56] References Cited

U.S. PATENT DOCUMENTS 1,798,322 3/1931 Floyd et al. .
1,939,880 12/1933 Day .
2,619,662 12/1952 Hayes et al. .
2,814,813 12/1957 Young .
3,038,186 6/1962 Davy .
3,125,775 3/1964 Clifton .
3,304,659 2/1967 Eichhorn .
3,314,679 4/1967 Kolln .
3,820,183 6/1974 Gustafson et al. .
4,934,392 6/1990 Henfrey ..... 134/61

*Primary Examiner*—Asok Pal
*Attorney, Agent, or Firm*—Whitham & Marhoefer

[57] ABSTRACT

An apparatus and method for the transportation of golf balls, particularly at a driving range, which includes one or more tanks remote from a range house and in proximity to a driving target, in which golf balls can be separate from other objects and mixed with a fluid. This mixture is then pumped to a central location, during which the balls remain immersed in the fluid which is made to flow at high velocity, providing a cleaning action. The balls can then be subjected to further cleaning, if desired, separated from the fluid and the fluid returned to the tank in a substantially closed system. A high capacity ball cleaner is provided to furnish the further cleaning which is particularly adapted to be used with the ball processing system and method.

21 Claims, 2 Drawing Sheets 10
8
18
31
21
20
22
23
19
47
39
17
17'
15
16
13
13a
14
11
12
45
44
24
25

HIGH CAPACITY GOLF BALL PROCESSING SYSTEM AND METHOD

This application is a continuation of application Ser. No. 07/522,309 filed May 11, 1990, now abandoned.

BACKGROUND OF THE INVENTION

1. Field of the Invention

The present invention generally relates to a system and method for processing golf balls. More particularly, this invention relates to a system and method for cleaning and/or transporting a large number of golf balls at high speed.

2. Description of the Prior Art

The sport of golf enjoys a continuing increase in popularity at the present time. In addition to facilities on which the game of golf can be played, there are facilities for the practice of various aspects of the sport such as putting greens and driving ranges. The latter type of facility generally consumes a large amount of area since space is typically provided for a golf ball to be driven through the greatest flight distance of which the player is capable. In some instances, in order to reduce the area consumed by such a facility, a barrier such as a net is provided to stop driven golf balls in mid-flight. In either type of facility, a player will typically purchase a returnable container with a plurality of golf balls which he will then proceed to hit, in sequence, from a single location. It is also typical for a large number of players to drive golf balls from a plurality of spaced locations along one side of the facility in generally parallel directions.

Accordingly, it is common for a great number of golf balls to be in use at a given time. The golf balls are periodically or continuously collected and returned to a central location, often referred to as a club house or range house, where they are again loaded into containers and sold to be used again in a similar fashion. To expedite collection of the golf balls, mechanized equipment is typically used. A common type of equipment includes a tractor with a sweeping device which sweeps the balls into a basket. When the basket is filled, the operator will then drive the tractor to the range house carrying the balls to be reused.

This procedure has several evident drawbacks. First, the collection machinery will also pick up stones and will increase the amount of dirt or mud which adheres to the balls and which must be removed before reuse. Second, the use of such a piece of complicated and expensive machinery and a skilled operator to perform the transportation phase of this operation is extremely inefficient; the inefficiency being increased by the circuitous route which must often be followed in the interest of safety and to avoid interference with use of the driving range by players.

Further, after the balls are returned to the range house, they must be cleaned prior to reuse. Mechanized devices for performing this cleaning operation are known in the art. One such device has two counter-rotating disks with textured surfaces which are spaced apart by approximately the diameter of a golf ball (1.62 inches). A stream of water is used to irrigate the golf ball while it is propelled between the counter-rotating disks. Either fresh water must be used or, more typically, filtration and recirculation must be provided. Other devices for performing this function are known but such other devices are also characterized by providing a specific path for balls through the device such that the balls will be cleaned in sequence. These ball cleaning devices are therefore subject to jamming, requiring nearly constant supervision of an operator, and of low throughput, cleaning a relatively small number of balls per minute. There is also a trade-off between capacity and period of immersion of the balls as well as the further disadvantage that dirt and mud will tend to dry on the balls prior to cleaning, increasing the tendency for such mud or dirt to adhere even more strongly to the balls.

Since driving ranges are often relatively large facilities at which many players may concurrently practice, the labor and capital expenditure requirements of processing the golf balls are relatively high. Further, when the cleaning and redistribution operations are concentrated at a single central location, such as a range house, the labor-intensive phases of these operations present a physical limitation on how many players can be accommodated. If these operations are distributed between several range houses, variations n distribution may causes shortages of balls or require an increased number to be in use to avoid such shortages, again tending to increase the required capital expenditure.

Accordingly, it is seen that there is a need to increase the degree of automation of driving ranges, particularly in the operations of cleaning and transportation of golf balls. Since driving ranges exist where more than 60,000 golf balls may be driven in a single day, there is also a need to increase the capacity of systems performing these functions to levels where such numbers can be accommodated. Similarly, a higher degree of automation which will permit the use of driving ranges by more players and permit the increase in size of newly constructed driving ranges is needed.

SUMMARY OF THE INVENTION

It is therefore an object of the present invention to provide a high capacity method an apparatus for the processing of golf balls.

It is another object of the present invention to increase the level of automation of transportation and cleaning of golf balls.

It is a further object of the invention to avoid the use of ball collecting machinery for the purpose of transporting of golf balls.

It is an additional object of the present invention to reduce time between collection and washing of the balls and to provide maximum immersion time without reducing the capacity of the system or increasing the required number of balls in use at a given time.

In order to achieve the above objects, there is provided, in accordance with one aspect of the invention, a method of processing golf balls including the steps of placing golf balls in a fluid and accelerating the fluid containing the golf balls.

In accordance with another aspect of the invention, a method of cleaning and/or transporting golf balls is provided comprising the steps of forming a mixture of a fluid and a plurality of golf balls and pumping the mixture from a first location to a second location.

In accordance with a further aspect of the invention, a system for processing golf balls is provided including a tank containing a fluid, a device for introducing golf balls into a fluid to form a mixture of the fluid and the golf balls, and a pump for pumping said mixture from a first location to a second location.

In accordance with an additional aspect of the invention, a cleaning device and method is provided including a conduit into which the balls are introduced and an agitator means for agitating the golf balls against the inner surface of the conduit.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figures 1, 4:
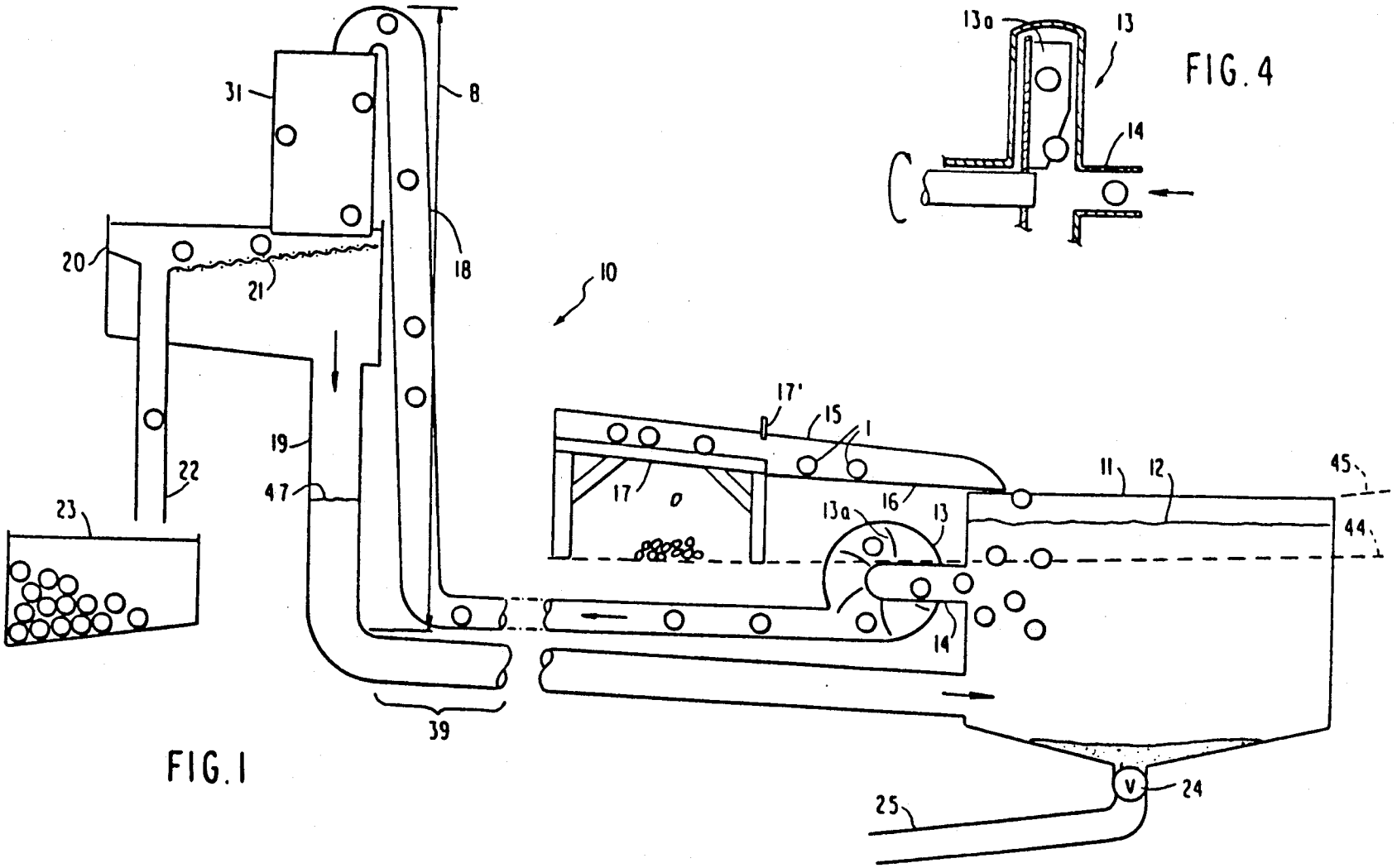
FIG. 1 is a schematic illustration of the system according to the invention.
FIG. 4 is a cross-sectional view of a portion of pump 13.

Referring now to the drawings, and more particularly to FIG. 1, there is shown, in schematic form, the overall structure of golf ball processing system 10. The system circulates a fluid, preferably water, in a closed loop from a tank in which golf balls are mixed with the fluid. The mixture of the golf balls and fluid are then inducted into the pump 13 through induction conduit 14 by suction, accelerated by, for example, an impeller 13*a* within the pump and discharged, under pressure, through conduit 18. Conduit 18 is preferably a nominal four-inch diameter pipe commonly available. It is deemed desirable that the inside diameter of the pipe be approximately three times the diameter of a golf ball to maintain flow velocity within the pipe as well as some turbulence without permitting substantial slowing of the flow at any location within the volume of conduit 18. Care must also be exercised in the selection of pipe since it has been found that one particular brand and grade of nominal four-inch PVC pipe is of an inside diameter which will allow four balls to wedge across the pipe by slight flexing of the sidewalls thereof. Even this type of pipe may be operable to practice this invention if sidewall flexing is suitably restrained. Typically, jamming will not occur unless water flow rate is severely restricted while golf balls are in the system. Jamming usually occurs when flow rate increases after restriction.

Conduit 18 preferably discharges at an elevated location and preferably into a golf ball cleaning device 31, which will be described in detail below, and which should be considered as optional in the basic system. The mixture of fluid and golf balls are thus discharged into a trough 20 which can advantageously be located on the roof of the range house. Besides providing a convenient elevation of trough 20, such a location can incidentally provide significant evaporative cooling of such a range house, providing enhanced comfort to the attendant thereof. The golf balls are separated from the fluid by an inclined screen 21 which supports the golf balls but allows the fluid to freely flow through to be collected in trough 20. The golf balls are propelled by gravity along the inclined screen and into conduit 22 by which they are conveyed, also preferably by gravity into bin 23 from which they are retrieved by an attendant for distribution to players. The bottom of bin 23 is preferably inclined downwardly in the direction of the attendant's preferred position to insure that the golf balls will be easily retrieved by the attendant. Since the balls will carry some moisture when discharged through conduit 22 a drain (not shown) can advantageously be provided at the lower end of bin 23. Alternatively, the bottom of the bin can be fabricated from a perforated plate or even screening similar to screen 21. To minimize moisture in the bin, conduit 22 preferably extends a substantial distance above the maximum water level in trough 20 which can be easily determined through experience for each installation. Generally speaking, if trough 20 is positioned five feet or more above water line 12 (or 47), conduit 18 is a nominal four-inch pipe and conduit 19 is a nominal six-inch pipe, pump discharge pressure is not excessive and the horizontal cross-sectional area of trough 20 is twenty square feet or more, a rise of six inches of conduit 22 above the bottom of trough 20 will be sufficient to prevent objectionable amounts of fluid from entering conduit 22. Increase of horizontal cross-sectional area of trough 20 and increase of distance of conduit 22 from the discharge point of conduit 18 (either or both of which may be desirable to enhance evaporative cooling of the range house) will generally reduce surface turbulence and reduce the amount of rise which will be found to be satisfactory. Baffles (not shown) may also be used to decrease the rise of conduit 22 above the bottom of trough 20, should such a decrease be necessary in a particular installation.

From trough 20, a drain is provided into conduit 19 which is preferably larger in diameter than conduit 18. A nominal six-inch diameter pipe has been found to be sufficient for a flow rate of about 200 gallons per minute established through a nominal four-inch conduit 18. Fluid is thus returned to tank 11 which is preferably of a capacity to allow sedimentation in the tank. Sedimentation can be enhanced by the addition of a flocculent or the like to the fluid, which is preferably water. In practice, this has not been found necessary. Sediment will thus collect at the inclined portion of the bottom of tank 11 and can be purged from the system by the opening of valve 24 through drain conduit 25. An additional settling tank can be also be provided and may be particularly useful where purging of tank 11 may be difficult due to the grade level at the desired location. When such a purge of sediment is carried out, replenishment of the fluid will be necessary. The purging interval will depend, in part, upon the volume and horizontal cross-sectional area of tank 11 and is typically on the order of several days at maximum use.

As perfecting features of the system 10, tank 11 is preferably installed with respect to ground level 44 such that fluid level 12 will be about six inches above ground level 44. This arrangement provides what is considered to be the greatest convenience for maintenance of the system and allows conduits 18, 19 to be buried in the immediate vicinity of tank 11. Alternatively, and with particular regard to smaller driving ranges where a barrier is provided to interrupt the flight of driven golf balls, the tank can be advantageously be installed at ground level or, alternatively, at any convenient level with respect to a conveyor arrangement such as inclined grade 45 and/or 15. Whether or not such an inclined grade or other conveyor such as a mechanical conveyor is provided, it is deemed preferable that a rack or trap 17 be provided in an inclined area to allow separation of balls from foreign matter such as rocks having a different dimension than the golf balls. Typically, foreign matter of a smaller dimension will drop through grating 17, which is preferably formed of parallel strips which are arranged at a spacing of about 1.5 inches, on center. Rocks having a dimension greater than this spacing will either be sufficiently out of round to remain on the grate 17 or be restrained by bar 17', arranged transversely across the lower end of the grating 17 and spaced above it by a distance slightly greater than the diameter of a golf ball, to be removed manually. Such a trap for foreign matter may also include a chute 16 to assist in regulating the position at which the golf balls are mixed with the fluid.

Water level 47 will usually be somewhat above water level 12 during operation of the system. Water level 47 depends upon flow rate and the diameter of conduit 19 should be chosen to provide a flow rate which substantially avoids sedimentation within conduit 19. In any case, at least where the major run of conduit 19 is installed horizontally or with a slight incline to enhance flow by gravity, sedimentation in conduit 19 will be self-limiting. It should be noted however, that if the geographical circumstances of the installation so require, a return flow pump can be provided, preferably in the area indicated by bracket 39. In such a case, it may be desirable to reduce the diameter of the return conduit 19 downstream of such a return pump to increase flow velocity and reduce sedimentation.

Figure 2:
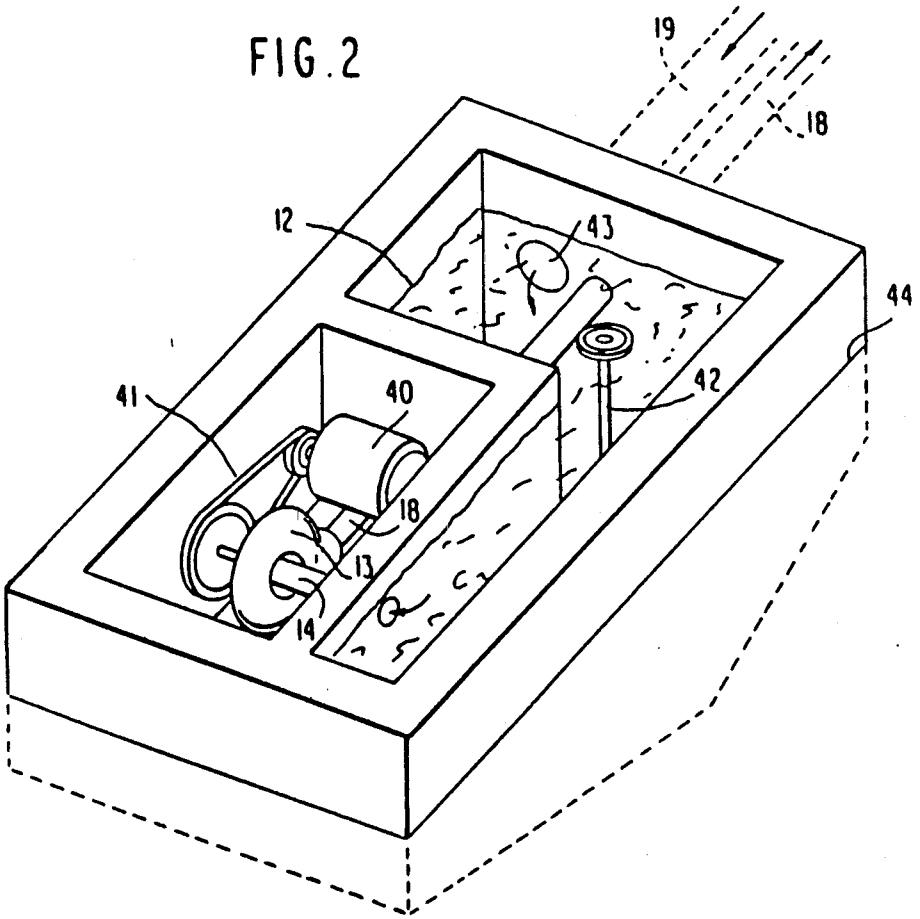
FIG. 2 is an isometric view of a preferred arrangement for the tank 11 of FIG. 1.

Referring now to FIG. 2, a preferred form of tank 11 will be described. Insofar as possible, common reference numerals will be used in the description of FIG. 2 as in the description of FIG. 1.

The overall cross-sectional shape of tank 11 is rectangular with a rectangular partition arranged to provide a housing for pump 13, motor 40, mechanical drive coupling 41 and induction conduit 14 as well as outlet conduit 18, leaving a generally L-shaped portion to form tank 11. Return conduit 19 terminates in return exit opening 43. The rectangular partition essentially forms a baffle which enhances the sedimentation process mentioned above. Pump exhaust conduit 18 traverses tank 11 and this section can contain unions (not shown) which may be of use during maintenance. A control for valve 24 is preferably provided by control connection 42 within tank 11 which will assist in opening the valve 24 to remove sediment from tank 11 through conduit 25. The outlines of tank 11 depicted in this figure by dotted lines are preferably those portions which are installed below grade, as illustrated in FIG. 1.

The relatively narrow portion of the L-shaped portion of the tank is considered to provide a relatively strong fluid flow toward pump induction conduit 14 which assists in containing the golf balls in that vicinity. Additionally, it is to be noted that chute 15 in FIG. 1 is depicted in an orientation which is reversed, for convenience of illustration, from that being practiced as of the present date and it is considered to be preferable that the trajectory of golf balls discharged from the chute 15 or 16 will traverse the general area of pump induction conduit 14. However, in practice, this tank configuration provides a flow which will allow induction of balls deposited anywhere within the tank.

Referring briefly now to FIG. 4, a cross-section of the preferred configuration of pump 13 will be explained. It is to be understood that while the pump 13 is preferably of the centrifugal type, other known types of pump, such as a diaphragm pump could be used. Pump 13 preferably includes an impeller which consists principally of a disc and impeller blades 13a. The impeller disc including blades 13a preferably is formed of steel and the impeller disc and blades are shaped to prevent or avoid jamming of golf balls within the pump housing. The configuration illustrated is commonly referred to as an open impeller configuration. A coating of a resilient material may be provided on the impeller to reduce damage to golf balls as they are propelled through the pump and may strike the impeller. In practice, such a coating has been found to be wholly unnecessary; a coating having been provided on the impeller initially, in experimental tests, but later found to have been totally abraded with no discernable increase in golf ball damage due to the golf balls having been inducted through the pump 13. In practice, it is estimated that only 1 ball in 10 actually strikes the impeller and actual damage is observed only on an extremely small number of balls.

The pump, motor 40 and drive arrangement 41 should preferably be chosen to provide a pressure suitable to raise the fluid over distance B shown in FIG. 1 and to provide a fluid flow velocity of 3-5 feet per second. In practice, a 12", open impeller pump, driven at 750 rpm by a 7½ horsepower electric motor has been found satisfactory in a generally flat installation and where height B is about 12 feet.

Figure 3:
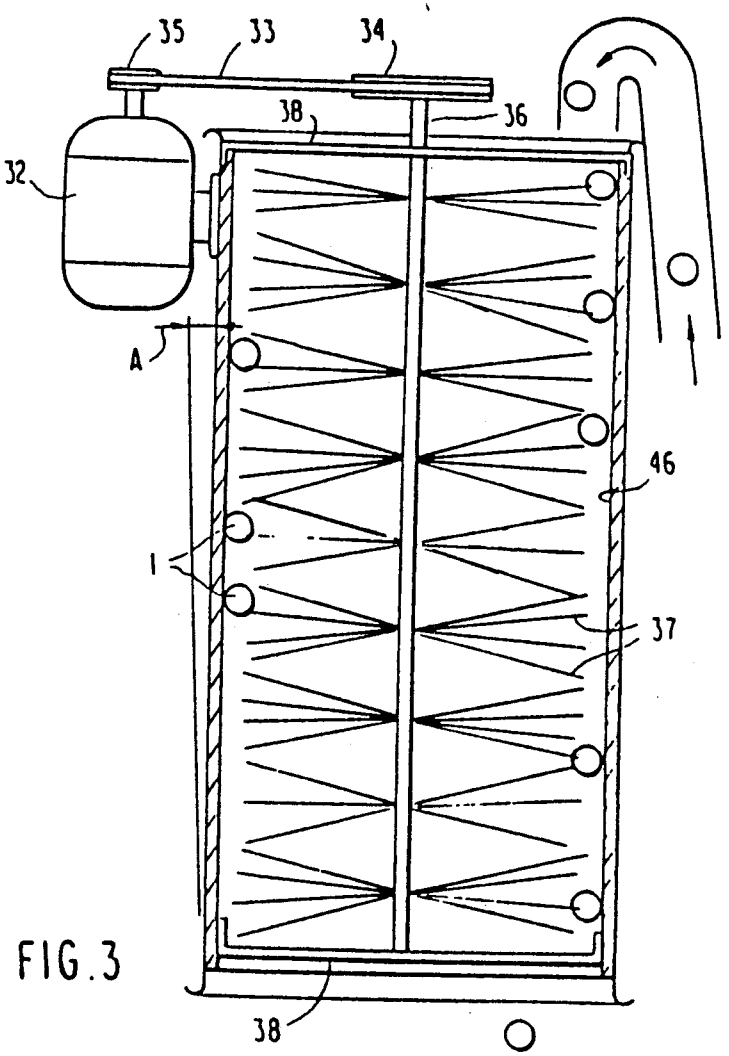
FIG. 3 is a sectional view of the high capacity ball cleaning device 31 of FIG. 1.

Referring now to FIG. 3, the configuration of the optional additional ball cleaner will now be described. It is to be understood that the basic system, described above, provides a substantially complete cleaning of golf balls pumped through a predetermined length of conduit; which cleaning action could be enhanced by adding a material such as a detergent to the fluid or by the choice of fluid itself. However, if even more complete cleaning of the golf balls is desired or found to be necessary, the configuration illustrated in FIG. 3 provides such additional cleaning at a capacity which is compatible with the high capacity of the basic system.

The optional ball cleaner illustrated in FIG. 3 comprises a generally cylindrical conduit which is axially aligned at an angle A with respect to a vertical direction in the installation. While it is deemed desirable that the angle A be limited to small angles so that the balls are maximally propelled by gravity and be propelled by brush 37 around the greatest portion of the circumference of the conduit, angles between 0° (vertical) and 90° (horizontal) are possible. At flow rates of about 200 gallons per minute, it is preferable to limit angle A to about 75° since greater angles would tend to concentrate the balls and reduce the high resistance of this ball cleaner to jamming. While it is also possible to propel the balls through the cleaner with water flow, the preferred flow rate of 200 gallons per minute would probably require a reduction of the diameter of the conduit 31, again reducing the potential capacity and resistance to jamming of the invention.

Agitator 36, preferably driven by motor 32, through pulley and belt arrangement 33, 34, 35 is preferably a brush which is somewhat smaller than the interior bore or inside diameter of conduit 31 by approximately the diameter of a golf ball. The rotary brush is preferably driven at 15-50 rpm. The bristles 37 of the rotary brush 36 then hold golf balls 1 against the inner surface of conduit 31. The ends of brush are supported by brackets 38. The inner surface of the conduit 31 is preferably provided with a textured surface 46, in which case, the inside diameter of the conduit 31 will be defined by the textured surface. Provision can be made for rotation of conduit 31 so that the entirety of the interior surface is equally washed by the fluid, but in practice, this has been found to be unnecessary.

In operation, the operator of ball collection machinery, if any, can merely transfer the collected balls to grate portion 17 of chute 15 and the balls will be conveyed rapidly to a distribution point such as a range house while simultaneously being cleaned in preparation for reuse. By positioning tank 11 in proximity to the ball collection area, optimum utilization of both machinery and personnel is made possible. The capacity of the system and method described is well in excess of 20 balls per second or 72,000 balls per hour. Thus, according to the invention, a system and method has been provided which provides for the simultaneous and automated transportation and cleaning of a large number of golf balls, reducing requirement of labor and supervision and permitting more effective use of other equipment on golf driving ranges.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. An apparatus for processing golf balls including
a tank containing a fluid,
means for introducing golf balls into said tank to form a mixture thereof consisting essentially of said golf balls and said fluid,
a trough including means for separating said golf balls from said fluid,
a conduit extending from said tank to a location proximate to said trough, and
a means for pumping said mixture of said golf balls and said fluid from said tank, through said conduit, to said trough.

2. A system as recited in claim 1 wherein said means for introducing said golf balls into said fluid includes a conveying means including an inclined area.

3. A system as recited in claim 2 wherein said means for introducing said golf balls into said fluid includes a means for separating said golf balls from other objects.

4. A system as recited in claim 1 wherein said means for pumping said mixture from a first location to a second location comprises a centrifugal pump.

5. A system as recited in claim 4 wherein said centrifugal pump is of the open-impeller type.

6. A system as recited in claim 1, further including a means for cleaning said golf balls comprising
a further conduit extending between said trough and said location proximate to said trough and positioned to receive said mixture of said golf balls and said fluid from said conduit and to discharge said mixture of said golf balls and said fluid into said trough, said further conduit having an inner surface and
an agitator means for agitating said golf balls against said inner surface.

7. A system as recited in claim 6, wherein said agitator means comprises a rotary brush positioned within said conduit.

8. A system as recited in claim 7, wherein said inner surface of said conduit is provided with a textured surface.

9. A system as recited in claim 1, further including means for separating said golf balls from said fluid.

10. A system as recited in claim 9, further including means for returning said fluid to said tank.

11. A system as recited in claim 10, wherein said means for returning said fluid to said tank includes a conduit having a volume approximately equal to or greater than that of said tank.

12. A system as recited in claim 1, wherein said fluid includes a cleaning agent.

13. A system as recited in claim 10, wherein said fluid includes a cleaning agent.

14. A method of processing golf balls including the steps of
forming a mixture of golf balls and a volume of fluid, said mixture of said golf balls and said fluid consisting essentially of said golf balls and said fluid,
pumping said mixture of said golf balls and said fluid from a first location to a second location through a predetermined length of conduit extending from said first location to said second location, and
separating said golf balls from said fluid at said second location,
whereby said golf balls are concurrently cleaned by said fluid and agitation within said conduit and transported from said first location to said second location.

15. A method as recited in claim 14, including the further step of
returning said fluid from said second location to said first location after said step of separating said golf balls from said fluid at said second location.

16. A method as recited in claim 14, wherein said step of pumping said mixture of said golf balls and said fluid from a fist location to a second location includes the steps of
inducting said mixture of said golf balls and said fluid into a first portion of said conduit by suction,
passing said mixture of said golf balls and said fluid through a pump, and
propelling said mixture of said golf balls and said fluid through a second portion of said conduit.

17. A method as recited in claim 14 comprising the further step of performing further cleaning of said golf balls, said step of further cleaning said golf balls including the steps of
introducing said mixture of said golf balls and said fluid into a further conduit,
passing said fluid and said golf balls through said further conduit by gravity, and
agitating said golf balls against a portion of an inner surface of said further conduit with a rotary brush concurrently with said step of passing said fluid and said golf balls through said further conduit by gravity, said golf balls being deflected from a gravity-directed path along said inner surface of said conduit by said rotary brush.

18. A method of processing golf balls comprising the steps of
introducing a mixture of golf balls and a volume of fluid into a conduit,
passing said fluid and said golf balls through said conduit by gravity, and
agitating said golf balls against a portion of an inner surface of said conduit with a rotary brush concurrently with said step of passing said fluid and said golf balls through said further conduit by gravity, said golf balls being deflected from a gravity-directed path along said inner surface of said conduit by said rotary brush.

19. An apparatus for processing golf balls comprising a conduit oriented such that a mixture of golf balls and a fluid may be passed therethrough by gravity, means for agitating said golf balls against a portion of an inner surface of said conduit, when said mixture of said golf balls and said fluid are passed through said conduit by gravity, whereby said golf balls are deflected from a gravity-directed path along said inner surface of said conduit by said rotary brush.

20. An apparatus as recited in claim 19, wherein said inner surface of said conduit is textured.

21. An apparatus as recited in claim 20, wherein said means for agitating includes a rotary brush.

* * * * *